United States Patent [19]

Cottingham

[11] 3,937,347

[45] Feb. 10, 1976

[54] APOTHECARY SAFETY CLOSURE

[75] Inventor: Hugh Cottingham, Orange, N.J.

[73] Assignee: Black Hole Nebula Incorporated, Orange, N.J.

[22] Filed: Mar. 27, 1975

[21] Appl. No.: 562,515

[52] U.S. Cl. ..... 215/213; 215/296

[51] Int. Cl.[2] ..... B65D 55/02; B65D 55/56; A61J 1/00

[58] Field of Search ..... 215/9, 211, 213, 296, 297

[56] References Cited

UNITED STATES PATENTS

| | | | |
|---|---|---|---|
| 3,409,159 | 11/1968 | Velt | 215/213 |
| 3,831,796 | 8/1974 | Claasen | 215/9 |

*Primary Examiner*—George T. Hall

*Attorney, Agent, or Firm*—Blum, Moscovitz, Friedman & Kaplan

[57] ABSTRACT

An apothecary safety closure for a bottle neck capable of preventing inadvertent opening of the bottle is provided. The safety closure includes a liner adapted to be inserted into and frictionally engaged by the bottle neck. The liner includes a recess therein and structure for effecting a removal of the liner from the bottle neck. A stopper includes a cylindrical wall portion adapted to be inserted into the liner recess and rotated therein. The cylindrical wall portion is formed with operative portions adapted to be selectively aligned with the operative structure on the liner in response to selective rotation of the stopper to effect removal of the liner from the bottle neck by the stopper.

7 Claims, 5 Drawing Figures

APOTHECARY SAFETY CLOSURE

BACKGROUND OF THE INVENTION

This invention is directed to an apothecary safety closure adapted to be inserted in a bottleneck, and in particular to an apothecary safety closure including a liner and a stopper, the liner effecting closure of the bottle neck, and being prevented from being inadvertently removed from the bottle neck unless the stopper is rotated in a predetermined manner.

Apothecary closures, namely, closures defined by a stopper insertable into a bottle neck have gained wide popularity in the packaging of drug items such as vitamins, aspirin and the like, due to their attractive appearance, and the identification by the consumer of such apothecary closures with drugstore merchandising. Nevertheless, such apothecary closures are easily removed from the bottle by children, and hence render same unsafe for use in packaging drug items which can pose a danger to a child's health and safety. Heretofore, modifications of apothecary closures in order to prevent same from being inadvertently removed, have been less than completely satisfactory.

SUMMARY OF THE INVENTION

Generally speaking, in accordance with the invention, an apothecary safety closure adapted to be inserted into a bottle neck and to prevent inadvertent removal therefrom isprovided. The safety closure includes a liner adapted to be inserted into a bottle neck and be frictionally engaged thereby to effect closure of the bottle neck. The liner defines a recess therein, the recess including first operative structure disposed on said liner for effecting removal of the liner from the neck. A stopper includes an elongated cylindrical wall portion adapted to be inserted into the liner recess and be rotatable with respect thereto, the cylindrical wall including second operative structure adapted to be selectively aligned with the first operative structure on the liner in response to selective rotation of the stopper to effect removal of the liner from the bottle neck by the stopper.

Accordingly, it is an object of this invention to provide an improved apothecary safety closure wherein inadvertent opening thereof by children is avoided.

Another object of this invention is to provide an apothecary safety closure wherein the safety feature of the cap isnot diminished by the facility with which same can be removed from the bottle.

Still another object of this invention is to provide an improved apothecary safety closure wherein a pulling of the stopper from the bottleneck does not effect opening of the bottle neck.

Still other objects and advantages of the invention will in part be obvious and will in part be apparent from the specification.

The invention accordingly comprises the features of construction, combinations of elements and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
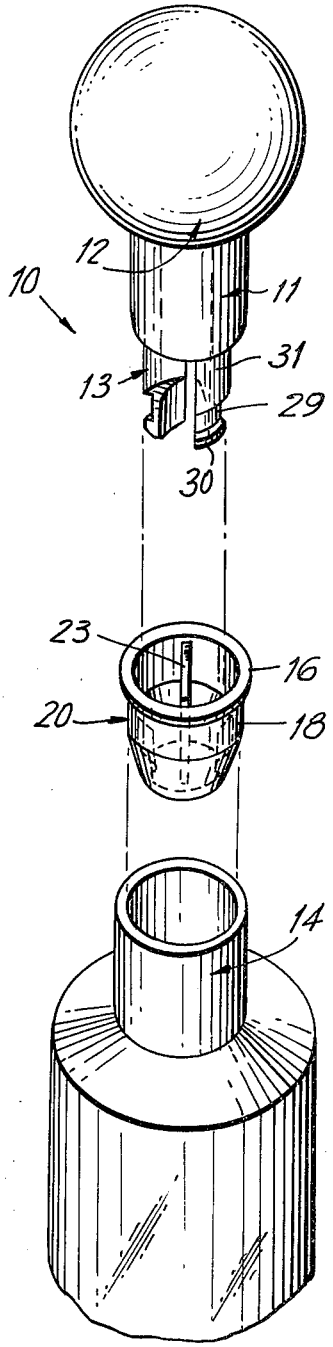
FIG. 1 is a perspective view of an apothecary safety closure constructed in accordance with the instant invention.

Reference is now made to FIG. 1, wherein an apothecary safety closure, generally indicated at 10, and constructed in accordance with the instant invention is depicted. The safety closure 10 includes a stopper, generally indicated as 11, including a stopper top 12 and an insertable portion 13 adapted to be inserted into a resilient plastic liner, generally indicated as 20, which liner is adapted to be frictionally engaged in a bottle neck 14.

Figure 2:
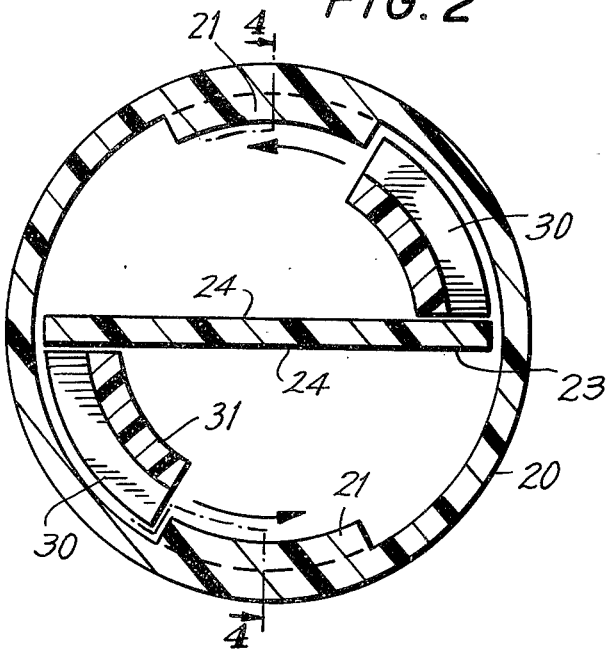
FIGS. 2 and 3 are respective sectional plan views illustrating different respective positions of the stopper and liner forming the apothecary closure in accordance with the instant invention.
Figure 3:
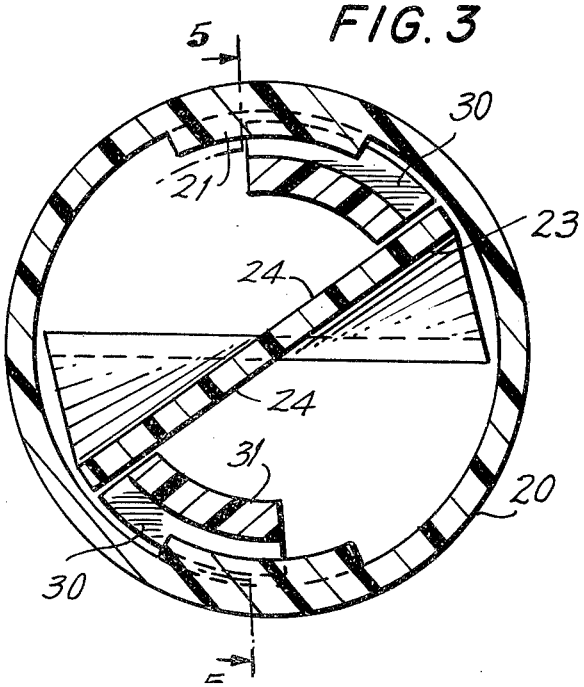
Figure 5:
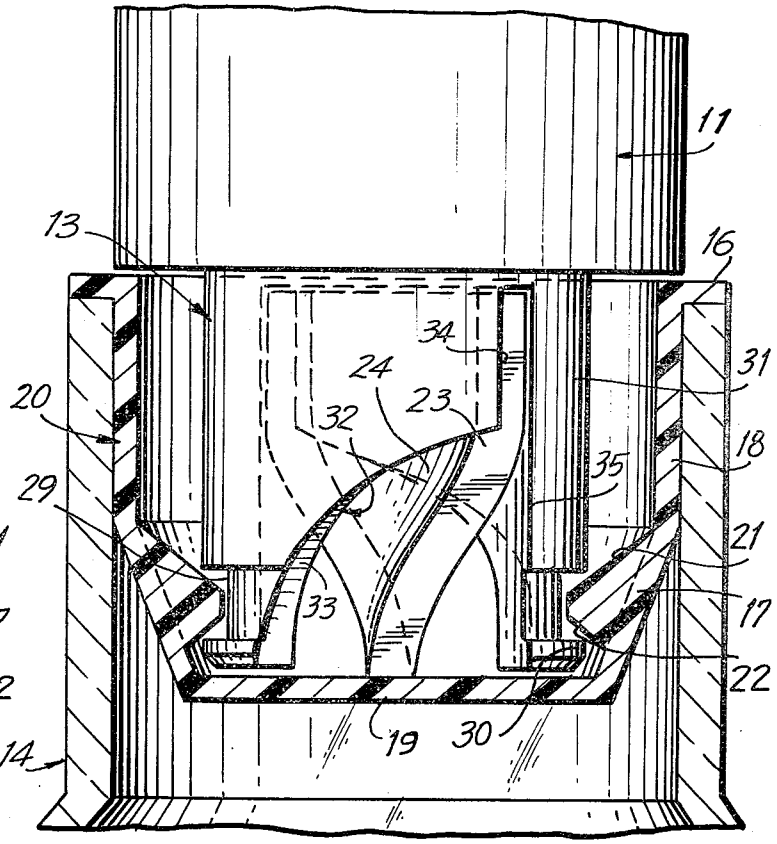
FIGS. 4 and 5 are in part elevational and in part sectional views taken generally along lines 4—4 and 5—5 when the cap is rotated in the positions respectively depicted in FIGS. 2 and 3.
Figure 4:
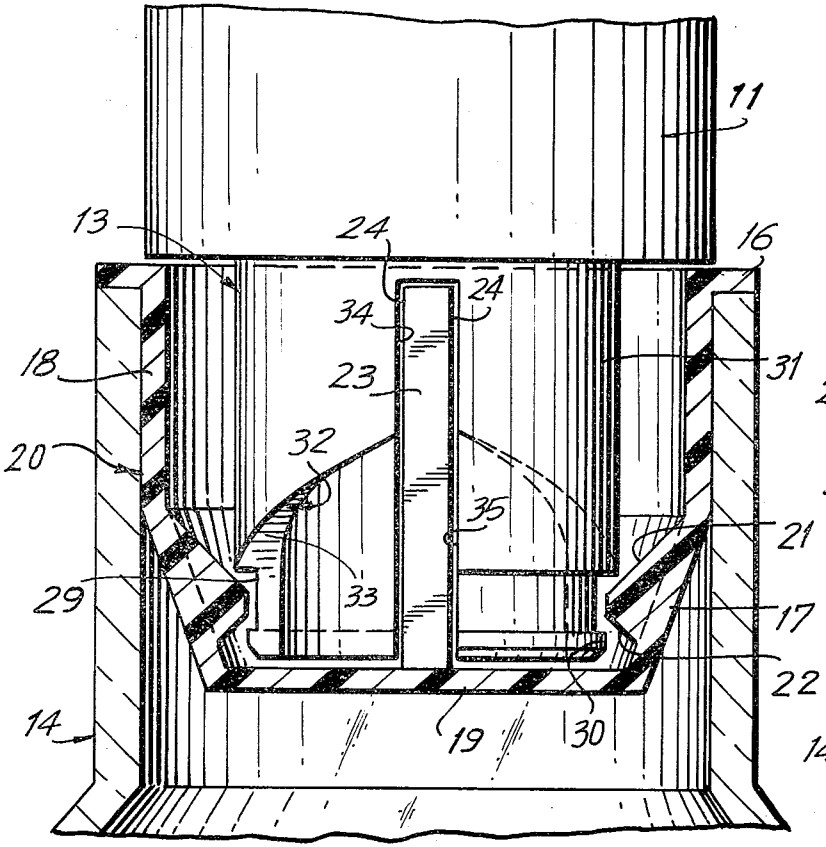

Referring specifically to FIGS. 4 and 5, liner 20 includes a cylindrical side wall 18 having a beveled wall 17 tapering into bottom wall 19 to define a cavity for receiving insertable portion 13. The cylindrical wall 18 terminates in an annular flange 16, which flange 16 is adapted to prevent the liner from being forced through the neck 14 into the bottle, and to further position the liner in frictional engagement with the bottle neck. As is more particularly illustrated in FIGS. 2 and 3, two radially projecting tabs 21 are formed on beveled wall 17, and define an undercut 22 to be explained with greater particularity below with respect to the operation of the instant invention. Disposed on bottom wall 19 and projecting almost the entire length of the liner and extending through the axis thereof is a resilient torsion blade 23 having flat opposed surfaces 24.

The insertable portion 13 of stopper 11 comprises a cylindrical stopper wall 31 defining cut away portions 32 having a first continuous curved surface 33 intersecting a straight lengthwise surface 34 spaced apart from a second straight cut away surface 35 extending along the full lengthwise extent of each cut away portion 32. The space between straight surfaces 34 and 35 is limited to allow torsion blade 23 to be inserted therein and be maintained in frictional engagement therewith. FIGS. 4 and 5 of the drawings illustrate a clearance between surfaces 34 and 35, but such clearance is illustrated for clarity only, such interfering engagement of the blade in the cut away portions effecting a releasable securing of the stopper to the liner. As is explained in greater detail below arc surfaces 33 effect positioning of the torsion blade in the slots defined by straight surfaces 34 and 35 and additionally permits the stopper to be rotated in the liner. An annular recess 29 is provided proximate the end of the remaining portions of cylindrical wall 31 to thereby define two radial projections 30 which projections are adapted to be rotated into alignment with the projections 21 on the liner in accordance with the instant invention.

In operation, the safety closure is inserted in bottle neck 14 and is frictionally engaged thereby. Although not depicted in FIGS. 2 and 4, the torsion blade 23 is inserted into friction engagement in the slot defined by the cut away portions 32. Accordingly, the projections 30 on the stopper wall are positioned out of alignment with the projections 21 on the liner wall. Thereafter, if the stopper top 12 is grabbed and pulled from the bottle, the frictional force of the bottle neck on the liner will be greater than the frictional force between the torsion blade and the cut away portions in the stopper wall, and hence the stopper will be withdrawn leaving the liner 20 securely positioned in the bottleneck, effectively closing same. Accordingly, the most natural motion likely to effect inadvertent removal of the apothecary closure, namely, pulling the stopper from the bottle, will not effect an opening thereof.

If the stopper is removed from the liner in the manner noted above, replacement of the stopper in the liner for effecting removal of the entire safety closure is facilitated by arced surfaces 33 which surfaces engage torsion blade 23 and direct same into the slot for frictional engagement therein. Thereafter, safety closure 10 is easily removed from the bottleneck by effecting a counterclockwise rotation of the stopper, as depicted by the arrows in FIG. 2, to thereby position stopper projections 30 in alignment with liner projections 21. The two arced cut away surfaces 33 permit the stopper to be rotated with respect to the torsion blade 23 in only a counterclockwise rotational direction, it being noted that straight surface 35 prevents rotation in the other or clockwise direction. Additionally, torsion blade 23, due to its resilient characteristic, will effect a return of the stopper to the position depicted in FIG. 2 if the rotational force applied to the stopper 12 is removed.

Accordingly, to effect removal of the liner 20 from the bottleneck, rotation of the stopper so that stopper projections 30 are in part aligned with liner projections 21, and simultaneously pulling the stopper, causes projections 30 to engage under cut surfaces 22 on the liner projections 21, and hence effect removal of the entire safety closure including the stopper and liner from the bottle neck.

It is noted that the stopper wall could include two continuous arc cut away portions on each side thereof in order to allow the stopper to be rotated in both the clockwise and counterclockwise directions. Nevertheless, by permitting rotation of the stopper in only one rotational direction, the possibility of inadvertent removal is lessened. It is further noted that the failure to provide receding arced surfaces for widening the slot in the stopper wall adapted to have the torsion blade inserted therein, will result in the inability to rotate the stopper in either direction.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An apothecary safety closure adapted to be inserted in a bottle neck comprising in combination a liner adapted to be inserted in said bottle neck and be frictionally engaged thereby to effect a closure of the bottle neck, said liner defining a recess therein, said recess including first operative means disposed on said liner for effecting removal of said liner from said neck, and a stopper including an elongated cylindrical wall portion adapted to be inserted into said liner recess and be rotatable with respect thereto, said cylindrical wall including second operative means adapted to be selectively aligned with said first operative means disposed on said liner in response to selective rotation of said stopper to effect a removal of the liner from said bottleneck by said stopper.

2. An apothecary safety closure as claimed in claim 1, wherein said first operative means includes at least two tabs projecting inwardly from said liner, and said second operative means includes two recesses in said substantially cylindrical wall of said stopper.

3. An apothecary safety closure as claimed in claim 1, wherein said substantially cylindrical stopper walls define two elongated diametrically opposed cut away portions, and said liner includes a torsion blade disposed therein, said torsion blade bring frictionally engaged by the remaining portions of said cylindrical wall defining said cut away portions in response to insertion of said stopper into said liner recess.

4. An apothecary safety closure as claimed in claim 3, wherein each said cut away portion includes an elongated slot having a widthwise dimension to effect friction engagement with said torsion blade means, and a receding portion for allowing said stopper to be rotated with respect to said liner.

5. An apothecary safety closure as claimed in claim 4, wherein said receding cut away portion is an arc surface, to thereby facilitate the insertion of said torsion blade means into said elongated slots in said stopper cylindrical wall.

6. An apothecary safety closure as claimed in claim 4, wherein said torsion blade means is resilient, and permits a partial rotation of said stopper in response to rotational force applied thereto, said torsion blade means effecting a return of said stopper to said insertion position upon a release of said rotational force applied thereto.

7. An apothecary safety closure as claimed in claim 6, wherein said first operative means includes at least two tabs projecting inwardly from said liner, and said second operative means includes two recesses disposed in the remaining portion of said substantially cylindrical stopper wall, partial rotation of said recesses into alignment with said tabs thereby allowing said liner to be removed from said bottle neck by said stopper.

* * * * *